United States Patent [19]

Stone, Jr.

[11] 4,447,999

[45] May 15, 1984

[54] APPARATUS FOR INCREASING THE SELF PARKING CAPACITY OF A PARKING LOT

[75] Inventor: Wayne B. Stone, Jr., Bethesda, Md.

[73] Assignee: Wood Mfg. Co., Inc., Flippin, Ak.

[21] Appl. No.: 318,959

[22] Filed: Nov. 6, 1981

[51] Int. Cl.[3] ..... E04H 6/10

[52] U.S. Cl. ..... 52/175; 414/228

[58] Field of Search ..... 52/174–176, 52/87, 234, 236.3; 414/227, 228; 14/24, 69.5

[56] References Cited

U.S. PATENT DOCUMENTS 2,610,364 9/1952 Brower et al. ..... 52/174

3,124,258 3/1964 Smith ..... 52/176

3,562,774 2/1971 Stone ..... 52/174

3,613,908 10/1971 Mulitz ..... 414/228

FOREIGN PATENT DOCUMENTS 301141 9/1965 Netherlands ..... 52/174

202597 8/1923 United Kingdom ..... 414/228

*Primary Examiner*—J. Karl Bell

*Attorney, Agent, or Firm*—Colton & Stone Inc.

[57] ABSTRACT

Multiple level, horizontal parking lanes are provided with self park automotive access from intermediate drive lanes inclined transversely to the direction of automotive travel therealong.

2 Claims, 5 Drawing Figures

APPARATUS FOR INCREASING THE SELF PARKING CAPACITY OF A PARKING LOT

BACKGROUND OF THE INVENTION

The purpose of the present invention is to increase the self parking capacity of an existent parking level such as a ground level parking lot. Exemplary prior art directed to the general subject matter is applicant's U.S. Pat. No. 3,562,774 and U.S. Pat. No. 2,610,364.

The disclosed construction avoids excavation and/or filling except for minimal footing excavations and may be constructed and/or added on to piecemeal as parking requirements increase.

SUMMARY OF THE INVENTION

The parking capacity of a given parking lot may be increased by approximately 50% at a per space cost increase of about half that required for conventional parking structures by employing a combination of elevated and ground level parking rows to which selective automotive access may be had via automotive drive lanes which are inclined transversely of the path of automotive travel. Additional ground level parking is beneath the inclined drive lanes with automotive access thereto being via a ground level drive lane underlying the elevated parking rows.

The construction materials used are standard, prestressed concrete shapes.

From the standpoint of practical application it is important that all cars be parked substantially horizontal and that pedestrian access to and from the cars be along stepped or horizontal pathways. The horizontal parking aspect has not previously been possible when utilizing an inclined drive lane as in U.S. Pat. No. 3,562,774 because of the constraints imposed by the maximum incline an automobile can traverse without undercarriage drag. This maximum incline is approximately 12°. In the present invention, the rear ends of two cars parked on opposite sides of an inclined drive lane, at lower and elevated levels respectively, are allowed to overlie the inclined drive lanes by as much as four or five feet while the wheels of the car rest on a horizontal level. This allows both the lower and elevated horizontal parking levels to approximate fifteen feet in length rather than the usual twenty feet. The result is a wider inclined drive lane which allows greater height above the lower parking level for adequate pedestrian head room on the lower level.

The most important concept, as related to the prior art and construction economy, is that of providing access to a head to head parking level from opposite sides thereof via drive lanes inclined transverse to the direction of automotive travel so that the same drive lanes affording access to the upper level parking spaces also provide access to spaced, outboard lower level parking spaces.

DESCRIPTION OF THE PREFERRED EMBODIMENT

Figure 1:
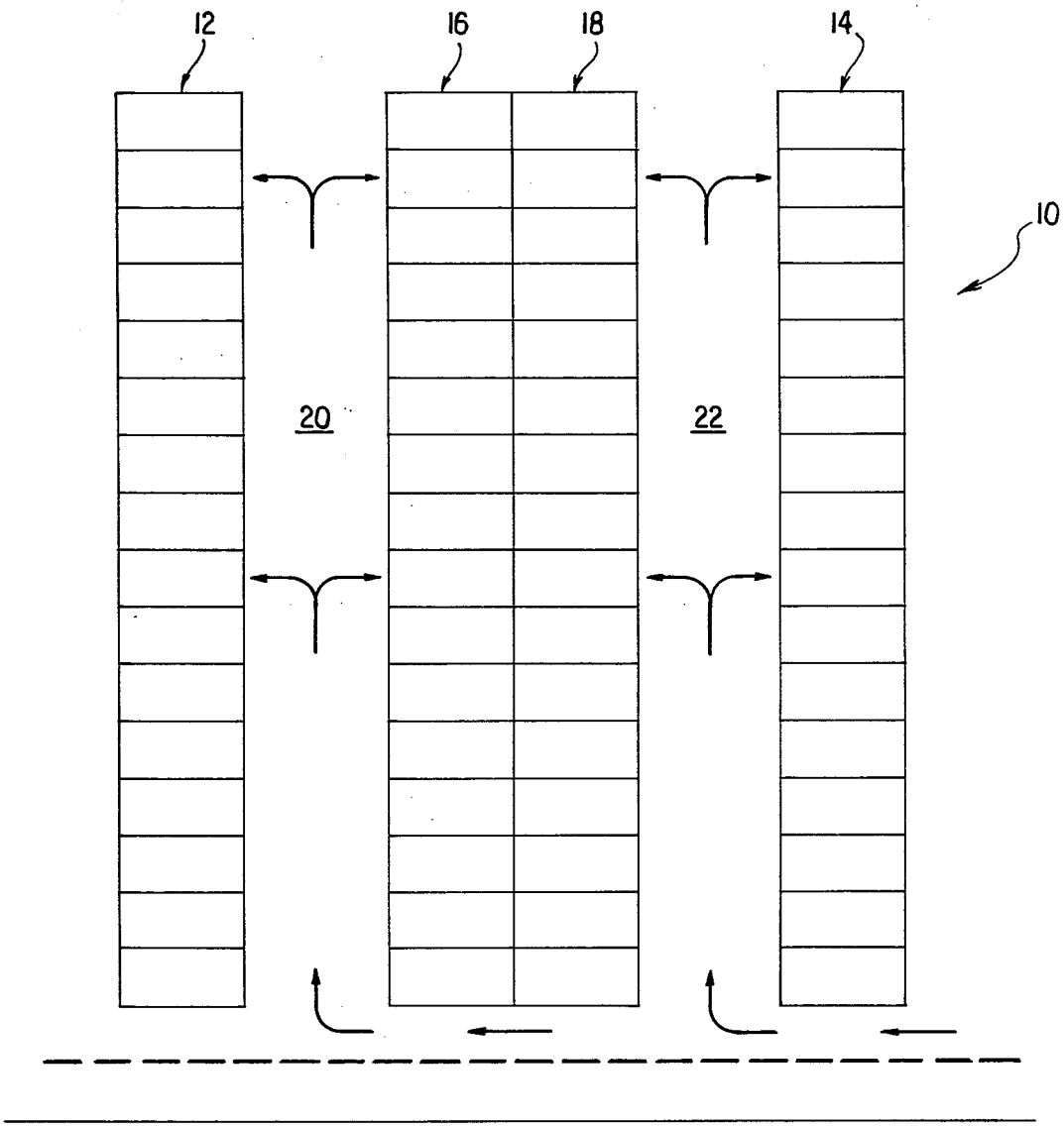
FIG. 1 (PRIOR ART)
FIG. 1 is a schematic plan view of a conventional parking lot.

In FIG. 1 is illustrated the maximum self park capacity of a conventional, single level parking lot. Such a lot is typically lined for parking spaces 20 feet long and 9 feet wide perpendicular to the access drive lanes. In the particular configuration shown in FIG. 1 the parking lot 10 is 126 feet wide and 144 feet deep with the outer parking rows 12, 14 being separated from the inner head to head parking rows 16, 18 by access drive lanes 20, 22 which are 23 feet wide. The maximum capacity of lot 10 is thus seen to be 64 cars.

Figure 2:
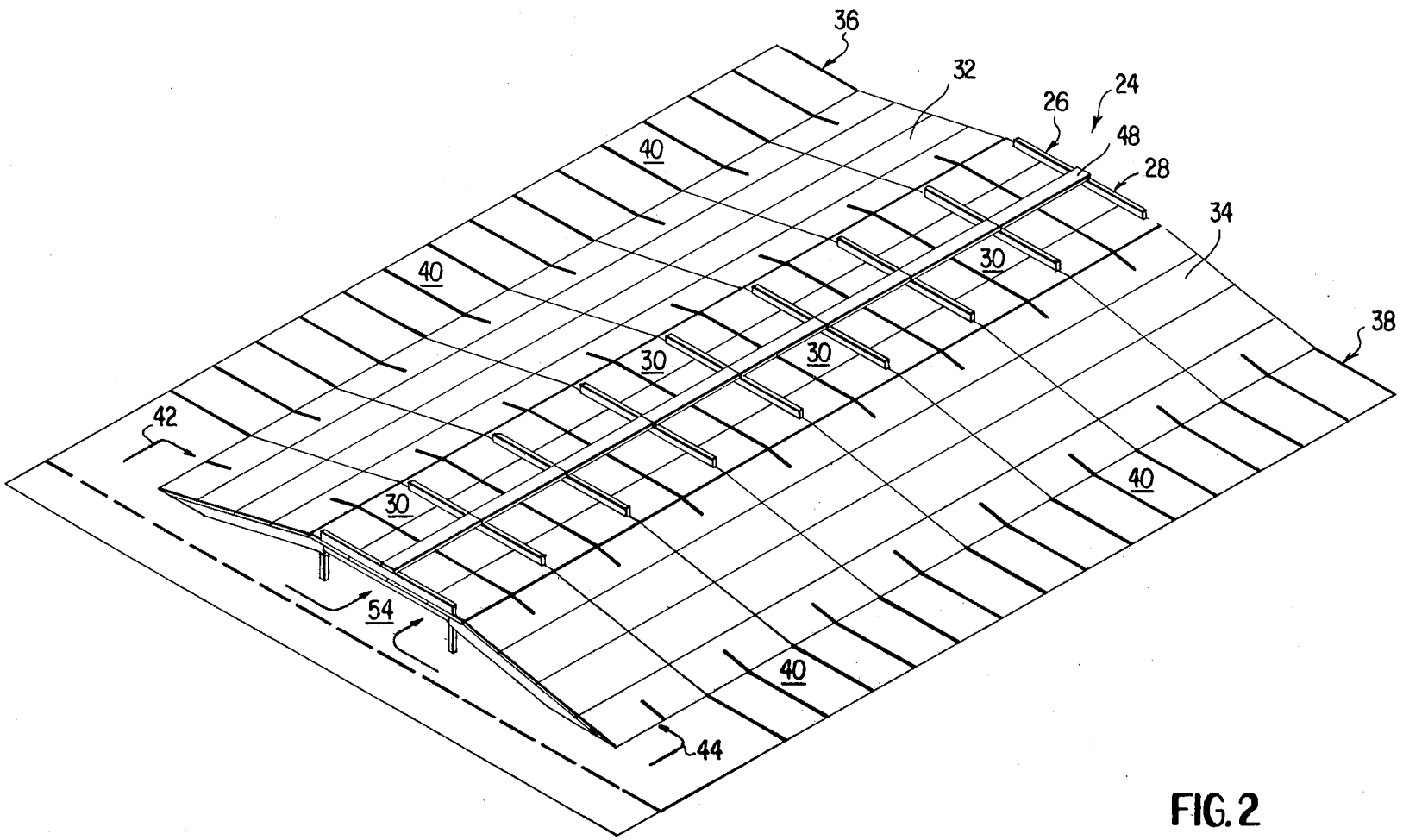
FIG. 2 is a perspective view of the automotive parking structure of the present invention.
Figure 3:
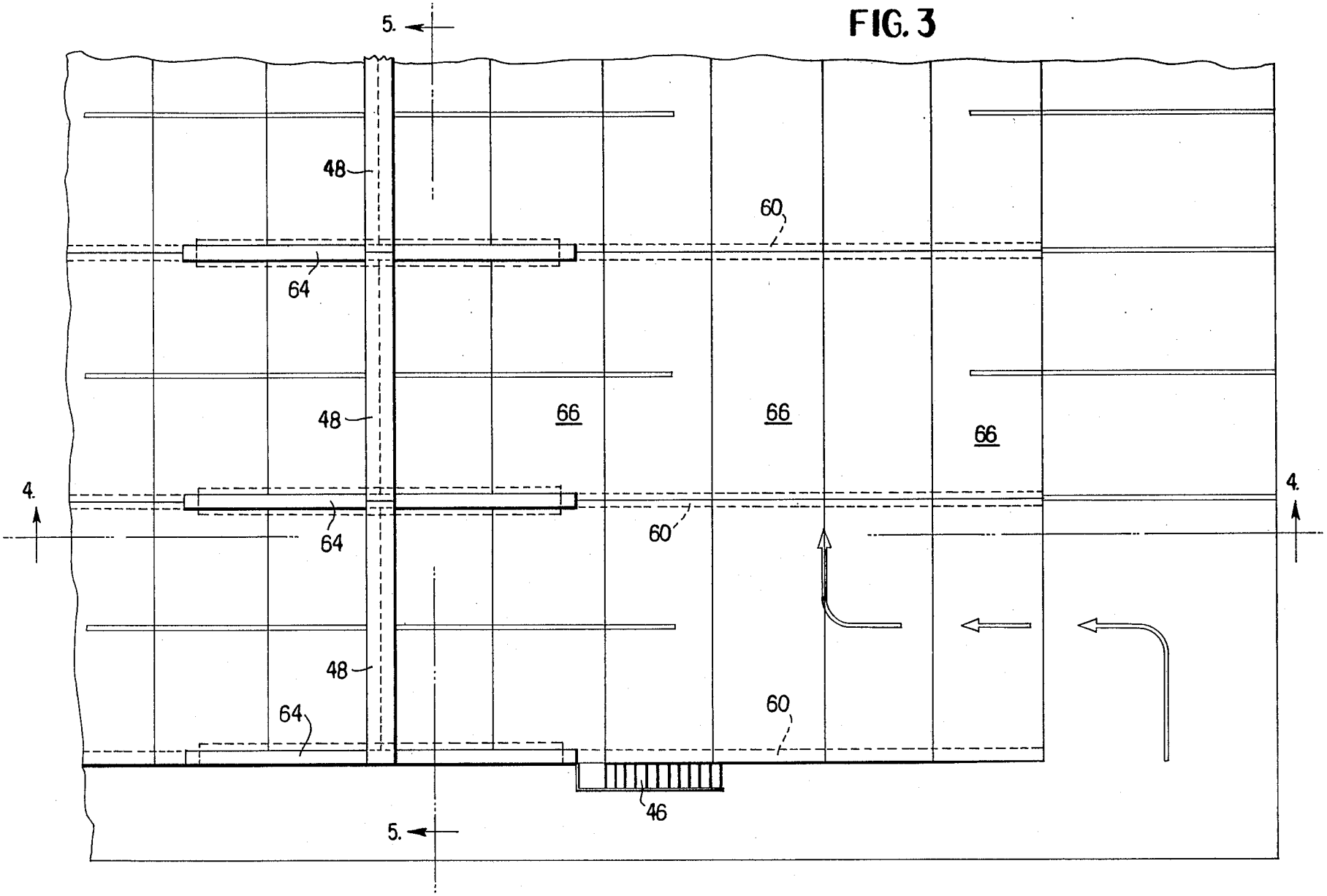
FIG. 3 is a broken plan view of one end of the parking structure shown in FIG. 2.

With the erection of parking structure 24 on lot 10, as in FIG. 2, 92 cars can be parked in an analogous self park mode.

Access to elevated parking rows 26, 28, lined on upper parking level 30, is via inclined drive lanes 32, 34, respectively bridging each elevated parking row 26, 28 and parking rows 36, 38 lined on the surface 40 of lot 10. Access onto the inclined drive lanes from lower 40 of lot 10 is from one end of the structure where the outer two parking spaces at one end of parking rows 36, 38 are omitted to provide access areas 42, 44 respectively. Pedestrian access to and from the upper parking level 30 is via stair 46 and sidewalk 48 dividing elevated parking rows 26, 28.

Figure 4:
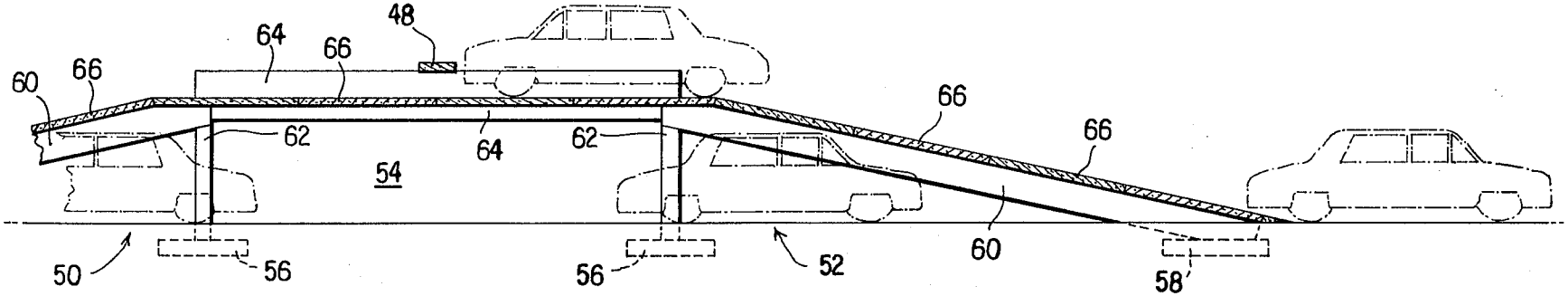
FIG. 4 is a sectional view taken along the line 4—4 of FIG. 3.
Figure 5:
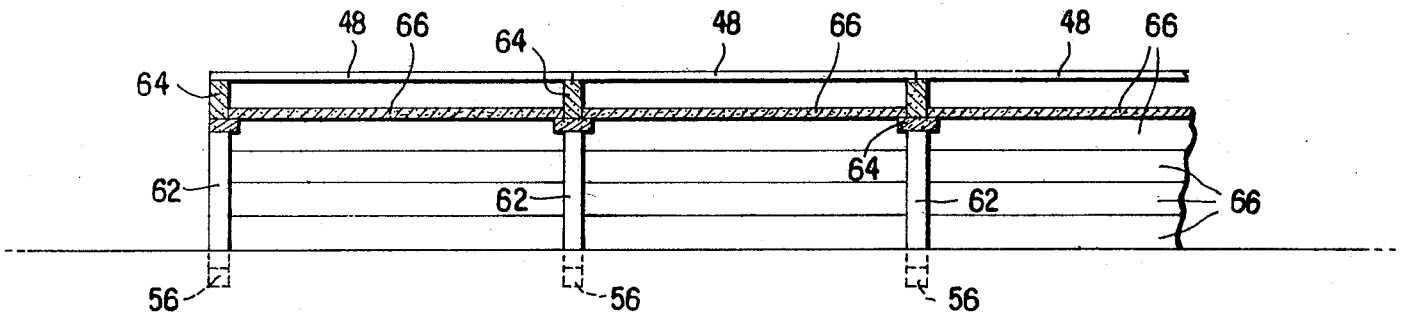
FIG. 5 is a sectional view taken along line 5—5 of FIG. 3.

Access to the lower, covered parking rows 50, 52 is via roadway 54 underlying upper parking level 30 (FIG. 4).

The entire structure 24 is made up of standard reinforced concrete shapes joined by conventional weld plate fastenings.

Small surface excavations are first made for footings 56 and 58. Beams 60 are supported by footings 58 and columns 62 upstanding from footings 56.

Beams 60 may be on 18 foot centers as are T beams 64 bridging columns 62. The beams 60 and T beams 64 are then spanned by slabs 66.

I claim:

1. In combination with means defining a lower parking level having an automotive drive lane affording access to a row of lower level parking spaces on either side thereof, the improvement comprising: means defining a substantially horizontal, elevated parking level parallel to and overlying said lower level drive lane throughout substantially the entire length thereof and providing two rows of elevated parking spaces thereon; means defining at least one row of parking spaces spaced outboard of and parallel to the adjacent one of said lower level parking rows; said outboard row of parking spaces being at a lower elevation than said elevated parking level; support means defining a pair of automotive drive lanes extending parallel to and along opposite sides of said elevated parking level to provide a path of automotive travel therealong and access to each of said two rows of elevated parking spaces; said last named pair of automotive drive lanes being inclined transverse to the direction of automotive travel therealong and each inclined drive lane being in spaced overlying relation to at least a portion of each said row of lower level parking spaces; one of said inclined drive lanes merging one side of said elevated parking level with said lower parking level; and the other of said inclined drive lanes merging the other side of said elevated parking level with said row of outboard parking spaces whereby selective automotive access may be had to either an elevated parking row or the lower, outboard parking row from said other inclined drive lane.

2. The combination of claim 1 wherein said outboard row of parking spaces are on said lower parking level.

* * * * *